United States Patent [19]

Anthony

[11] Patent Number: 4,908,591

[45] Date of Patent: Mar. 13, 1990

[54] STATIC CONVERGENCE DEVICE FOR TELEVISION PICTURE TUBE

[75] Inventor: Albert M. Anthony, Paw Paw, Mich.

[73] Assignee: Bangor Electronics Co., Bangor, Mich.

[21] Appl. No.: 307,430

[22] Filed: Feb. 7, 1989

[51] Int. Cl.[4] ..... H01F 7/00

[52] U.S. Cl. ..... 335/210; 335/212; 313/426

[58] Field of Search ..... 335/210, 212; 313/426, 313/427, 428, 431

[56] References Cited

U.S. PATENT DOCUMENTS 3,332,046 7/1967 Melone ..... 335/212

4,310,819 1/1982 Morita et al. ..... 335/212

*Primary Examiner*—George Harris

*Attorney, Agent, or Firm*—Burmeister, York, Palmatier & Zummer

[57] ABSTRACT

A static conversion device for a color television picture tube having a base unit, a central unit and a cap unit mounted in a stack about the neck of the picture tube. Each of the units centers a pair of magnetic rings, and the rings are mounted between outwardly extending tabs of adjacent units. The assembly is maintained in position on the neck of the picture tube by a plurality of pairs of fingers extending from the units to abut the neck of the picture tube.

18 Claims, 2 Drawing Sheets

STATIC CONVERGENCE DEVICE FOR TELEVISION PICTURE TUBE

This invention relates to static convergence devices for initially converging the three electron beams of an in-line color television picture tube.

BACKGROUND OF THE INVENTION

Conventional color television picture tubes are manufactured with discrete dots of phosphors of three different colors. Three electron beams are utilized to excite the phosphor dots of the three colors, respectively. Precise positioning of the three electron beams is necessary for each beam to excite the phosphor dots of its associated color. Stray magnetic fields and manufacturing variations of color picture tubes generally result in the beams failing to register with the associated phosphor dots, thus requiring beam correction which is effected by bending the electron beams with a magnetic field produced by purifying magnets. Beam correction devices are well known in the art, as described in U.S. Pat. No. Re. 27,209 of Robert R. Malone entitled BLUE LATERAL AND PURITY MAGNET ASSEMBLY, and U.S. Pat. No. 4,065,737 of the present inventor entitled STATIC CONVERGENCE DEVICES FOR COLOR TELEVISION PICTURE TUBES. Such beam convergence devices are in the form of an assembly which has a channel extending therethrough for accommodating the neck of a color television picture tube, and the assembly is secured to the picture tube by means of a clamp.

In recent years, great efforts have been made to reduce the size and cost of television sets. Such efforts have resulted in television color picture tubes with substantially shorter necks which have permitted a reduction in depth of the cabinet for the television sets. The use of such tubes, and the other reductions in size, have placed a demand for space within the cabinet of the television set, and made it desirable to materially decrease the size of convergence assemblies.

Convergence assemblies also introduce magnetic fields into the cabinet which may affect the functioning of certain components in addition to the color picture tube. Stray fields from the convergence assembly can be confined by reducing the size of the convergence assembly and therefore a reduction in the size of such convergence assemblies is further desirable.

It is also desirable to reduce the cost of convergence assemblies for an in-line color picture tube, but provide a convergence assembly which will facilitate precise adjustment of the three beams with the phosphor areas associated with the beams, respectively.

BRIEF DESCRIPTION OF THE INVENTION

The convergence assembly of the present invention utilizes a collar which is adapted to accommodate the neck of a picture tube. The collar is provided with a first and a second plurality of fingers which extend inwardly to engage the neck. The fingers have ends opposite the collar which have linear edges aligned with the central axis of the collar, and the fingers of the first plurality engage the surface of the neck of the picture tube at an acute angle which is the supplement of the angle between the second plurality of fingers and the surface of the neck. As a result, the fingers engage the neck in a manner to resist twisting of the collar in either direction with respect to the neck, and the need for a clamp, or the operation of attaching the clamp, is eliminated.

The collar is provided with a plurality of spaced lips at one end thereof, and a pair of flat circular magnets with an axial opening are disposed about the collar in abutment with the lips. Mounting a second similar collar with outwardly extending lips from one end co-axially on the first collar with one end in abuttment with the first collar results in the magnet rings on the first collar being disposed between and engaged by the lips of both collars.

The first and second collars are provided with a plurality of spaced hubs. The fingers extend inwardly from the hubs and the lips extend outwardly from the hubs of each collar. The hubs of the second collar are provided with channels which extend therethrough parallel to the central axis of the collar, and the hubs of the first collar are provided with a plurality of pins extending outwardly along axes parallel to the central axis of the first collar. The pins of the first collar are disposed within the channels of the second collar to assemble the two collars and the first pair of magnetic rings.

A sleeve is also provided which functions to mount a third pair of magnetic rings and to engage the second pair of magnetic rings on the second collar. The sleeve is provided with an outwardly extending flange at one end which has depending pins, and the pins are accommodated and anchored within channels of the second collar for purposes of assembly. The third pair of magnetic rings are disposed on the flange about the sleeve, and a plurality of teeth extending outwardly from the end of the sleeve opposite the flange retain and control movement of the third pair of magnetic rings.

The parts of the convergence assembly are all molded of plastic. Assembly of the parts merely requires mounting the three pairs of magnetic rings on the two collars and the sleeve and thereafter mounting the first collar and the sleeve on the second collar, thus resulting in an assembly which is inexpensive to produce and to assemble. In addition, the elimination of mounting brackets and the like conserves space and confines stray magnetic fields.

DESCRIPTION OF DRAWINGS

For a more complete description of the invention, reference is made to accompanying drawings, in which.

DETAILED DESCRIPTION OF THE INVENTION

Figure 1:
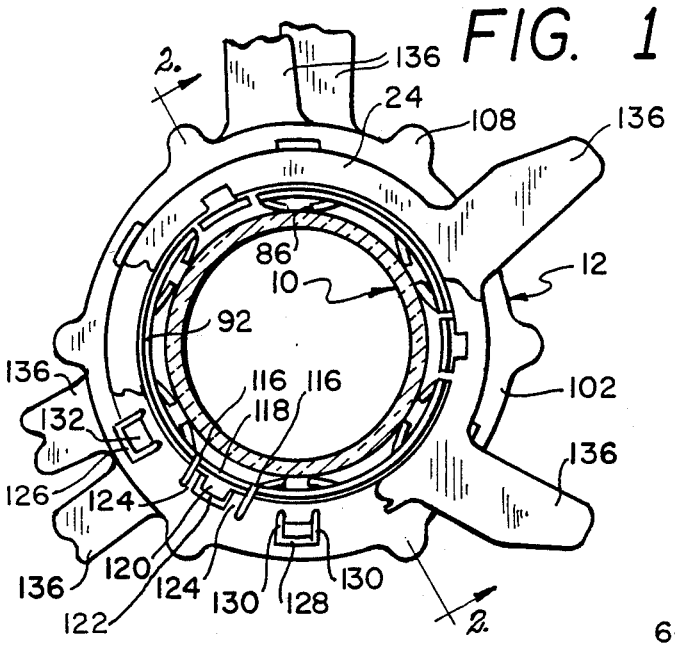
FIG. 1 is a plan view of a convergence assembly constructed according to the present invention mounted on the neck of an in-line color television picture tube, the neck being illustrated in section.

FIGS. 1 through 4 illustrate the neck 10 of an in-line three beam color television picture tube and a convergence assembly 12 constructed according to the present invention mounted on the neck of the picture tube. The convergence assembly 12 consists of a base unit 14, a central unit 16, a cap unit 18, and three pairs of ring magnets 20, 22, and 24, as best illustrated in FIG. 5.

Figure 3:
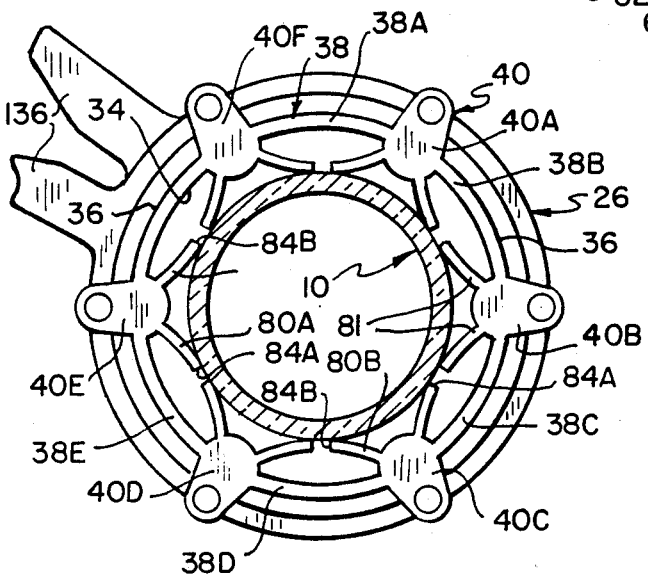
FIG. 3 is a sectional view taken along the line 3—3 of FIG. 2 illustrating in elevation the side of the convergency assembly opposite to that of FIG. 1.
Figure 2:
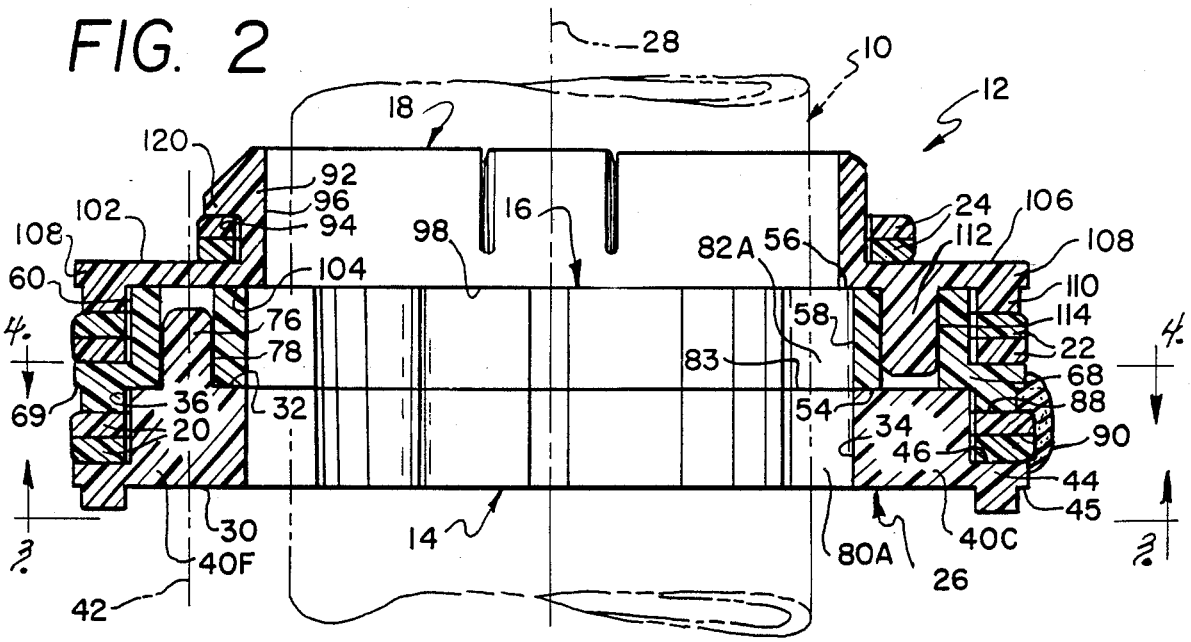
FIG. 2 is a sectional view of the convergence assembly taken along the line 2—2 of FIG. 1, the neck of the picture tube being illustrated in phantom.

The base unit 14 is illustrated in FIGS. 2 and 3 and has a cylindrical collar 26 which is co-axial with the central axis 28 of the neck 10 of the picture tube. The collar 26 has spaced parallel flat ends 30 and 32 disposed normal to the central axis 28 of the neck 10, and an inner cylindrical wall 34 and an outer cylindrical wall 36 extend between the ends 30 and 32. The collar 26 is divided into six part cylindrical segments 38 of equal length by six hubs 40. Individual segments are designated 38A, 38B, 38C, 38D, 38E, and 38F, and individual hubs are designated 40A, 40B, 40C, 40E, and 40F. Each of the hubs 40 is cylindrical with a central axis 42 parallel to the central axis 28 of the neck, and each hub 40 extends between the flat ends 30 and 32. Also, each hub 40 has a flat lip 44 extending outwardly therefrom and from the neck 10 of the picture tube, and each lip has a flat surface 45 extending from the end 30 of the base unit 14 and a second opposed parallel flat surface 46.

The hubs 40 provide a means for mounting the first pair of magnet rings 20 on the convergence assembly and centering these rings 20 on the central axis 28 of the picture tube. Each of the magnet rings 20 has parallel flat walls 48 and an axial cylindrical opening 50 with a diameter slightly greater than the distance between the outer surfaces of opposing hubs 40 of the base unit 14. The rings 20 are stacked one on the other with one wall 48 of one ring slidably abutting one wall 48 of the other ring and the axial openings 50 of the rings 20 disposed about the hubs 40 of the base unit 14. One of the rings 20 is disposed slidably on the surfaces 46 of the lips 44 of the base unit 14, and as will be explained hereafter, the remote surface of the other ring 20 is slidably engaged by the central unit 16.

Figure 4:
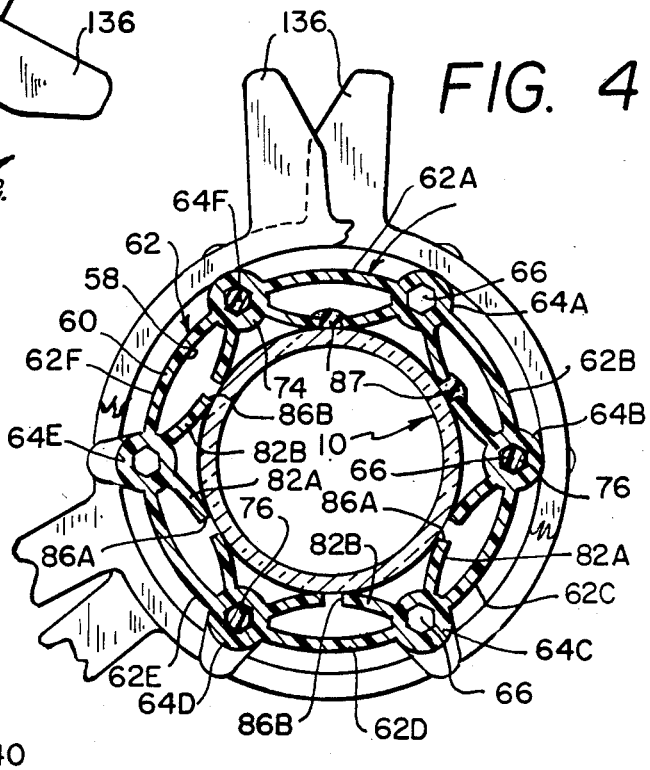
FIG. 4 is a sectional view taken along the line 4—4 of FIG. 2.
Figure 5:
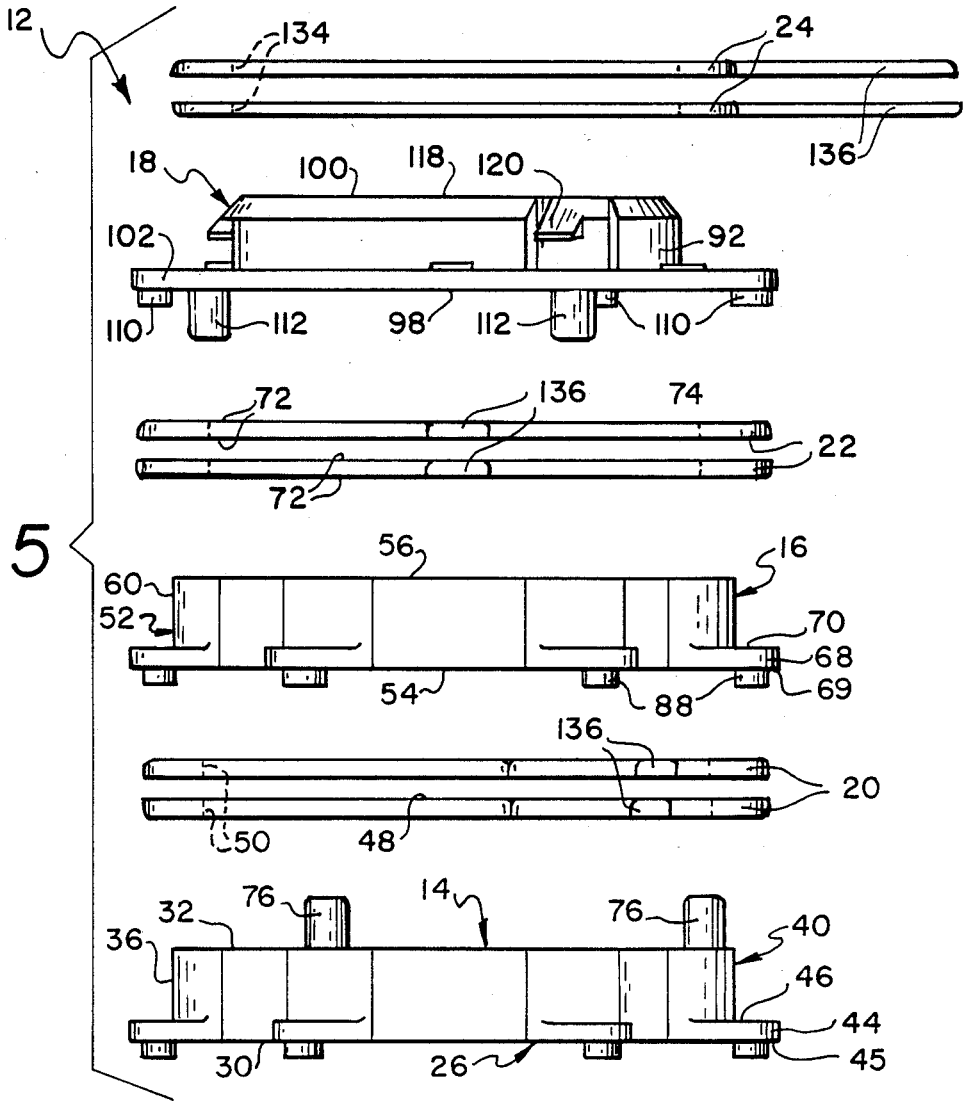
FIG. 5 is an exploded side elevational view of the convergence device of FIGS. 1 through 4.

As illustrated in FIGS. 2 and 4, the central unit 16 has a cylindrical collar 52 which is the same diameter as the collar 26 of the base unit 14 and co-axial with the collar 26. The collar 52 has spaced parallel flat ends 54 and 56 disposed normal to the central axis of the collar 52, and an inner cylindrical wall 58 and an outer cylindrical wall 60 extend between the ends 54 and 56. The collar 52 is divided into six part cylindrical segments 62 of equal length by six hubs 64. Individual segments are designated 62A, 62B, 62C, 62D, 62E, and 62F, and individual hubs are designated 64A, 64B, 64C, 64E, and 64F. Each of the hubs 64 is cylindrical with a central axial channel 66 co-axial with the axis 42 of the hubs 40, and each hub 64 extends between the flat ends 54 and 56.

Each hub 64 has a flat lip 68 extending outwardly therefrom and from the collar 52, and each lip 68 has a flat surface 69 extending from the end 54 of the central unit 16 and a second opposed parallel flat surface 70. Each of the magnet rings 22 of he second pair has flat opposed parallel walls 72 and an axial opening 74 extending therethrough, and one of the rings 22 of the pair is disposed on the surfaces 70 of the lips 68, the other ring 22 of the pair being slidably disposed on the first ring of the pair.

The hubs 40 and 64 also provide a means for mounting the base unit 14 on the central unit 16 of the convergence assembly. Three nonadjacent hubs 40 of the base unit 14, designated 40B, 40D and 40F, are provided with outwardly extending pins 76 and the pins 76 are snugly disposed within the channels 66 of the corresponding hubs 64B, 64D, and 64F of the central unit 16. The snug fit of the pins 76 within the channels 66 is sufficient to retain the base unit 14 and central unit 16 in assembled relation, but the addition of a layer 78 of cement may be used to secure this relationship.

The hubs 40 and 64 also function to mount and align the assembled base unit 14 and central unit 16 on the neck 10 of the picture tube. Each of the hubs 40 and 64 is provided with a pair of outwardly extending fingers 80 and 82, respectively, which engage the neck 10 of the picture tube and wedge the neck co-axially within the collars 26 and 52 of the base unit 14 and central unit 16. Individual fingers of each pair of the base unit 14 are designated 80A and 80B, and individual fingers of each pair of the central unit 16 are designated 82A and 82B. Each finger 80 or 82 is in the form of thin elongated part-cylindrical segments with edges 81 and 83 disposed on the planes of the ends 30 and 32 of the base unit 14, or the ends 54 and 56 of the central unit. Each of the fingers 80A and 80B has a flat end 84A and 84B, respectively, which is perpendicular to the axis of elongation of the fingers and each of the fingers 82A and 82B has a flat end 86A and 86B, respectively, which is perpendicular to the axis of the finger. Each of the fingers 80 and 82 is of the same arc length, and the arc length of the segments may be as great as one-half of the length of the segments 38 and 62. The fingers 80 and 82 extend from the hubs 40 or 64, respectively, at the same acute angle to the collar 26 or 52, respectively, that angle being approximately 45 degrees in a preferred construction. For portions of the fingers 80 and 82 adjacent to the ends 84 or 86, the curvature of the fingers reduces the angle to the collar 26 or 52 to approach the tangent to a cylindrical surface of revolution disposed at the ends 84 or 86 of the fingers 80 and 82, respectively. In the preferred construction of a convergence assembly, the angle of the fingers 80 and 82 to the collar 26 or 52 measured from the ends 84 and 86 thereof is approximately 30 degrees.

The neck 10 of the picture tube is of slightly greater diameter than the surface of revolution upon which the ends 84 and 86 of the fingers 80 and 82 lie, thereby exerting force and bending the fingers 80 and 82 toward the collar 26 or 52. The outer surface of the neck 10 of the picture tube is not perfectly smooth or cylindrical, and the fact that there are a plurality of fingers 80A and 82A with flat ends 84A and 86A forming sharp edges with the walls of the fingers which lodge within the recesses of the neck, and as viewed in FIG. 4 resist clockwise rotation. In like manner, the fingers 80B and 82B have ends which lodge in such recesses to resist counterclockwise rotation of the convergence assembly on the neck 10 of the picture tube. The force of the fingers 80 and 82 on the neck 10 is sufficient to retain the convergence device in position on the neck 10 of the picture tube during use under most service conditions, however, a small mass 87 of cement may be placed on the ends 84 and 86 of the fingers 80 and 82 and the neck 10 to secure the convergence assembly on the neck under adverse operating conditions.

Each of the lips 68 of the central unit 16 is provided with a knob or protuberance 88 which extends outwardly from the plane of the end 54 to confront and engage the adjacent magnet ring 20. The magnet rings 20 are rotatable with respect to each other and with respect to the collar 26, but rotation is against the friction established by the snug fit of the rings 20 between the surfaces 46 of the lips 44 and the knobs 88 of the lips 68, thereby making movement during normal service unlikely. The rings 20 may be locked in place by a mass 90 of cement which extends over the rings 20 and both lips 44 and 68.

The cap unit 18 is provided to retain the second pair of magnet rings 22 in position on the central unit 16 and to support the third pair of magnet rings 24. Since the cap unit 18 does not support the convergence assembly on the neck 10 of the picture tube, a cylindrical sleeve 92 with an outer surface 94 of smaller outer diameter than the outer surfaces of collars 26 and 52 is employed, but the sleeve 92 has an inner surface 96 of larger diameter than the neck 10 of the picture tube . The sleeve 92 has opposite ends 98 and 100, and the end 96 is disposed in abuttment with the end 56 of the central unit 16. A circular flange 102 is disposed at the end 98 of the sleeve 92 and the flange has flat parallel opposed surfaces 104 and 106, the surface 104 being in the plane of the end 98. The outer diameter of the flange 102 is between the diameter of the opening 74 and outer diameter of the magnet rings 22, and lips 108 extend outwardly to confront the lips 68 of the central unit 16. Each of the lips 108 has an outwardly extending knob 110 which confronts and frictionally engages the magnet rings 22 disposed on the central unit 16 to retain the magnet rings 22 in relative position after adjustment.

The flange 102 has three pins 112 extending outwardly from the end 98, and the three pins are disposed on radial planes traversing alternate lips 108. The pins 112 are cylindrical and tightly disposed within the channels 66 of the central unit 16 to mount the cap unit 18 on the central unit. A layer of cement 114 between each pin 112 and the confronting channel surface can be used to assure assembly.

The sleeve 92 has three pairs of parallel slots 116 extending therethrough from the end 100 parallel to the central axis of the sleeve, and the slots extend through a right angled bend into the flange 102. The slots 116 of each pair are disposed on opposite sides of a lip 108 and form a tab 118 which is integral with flange 102. Each of the tabs 118 is provided with an outwardly extending tooth 120 which confronts and is spaced from the flange 102, and the third pair of magnet rings 24 is disposed between the teeth 120 and the surface 106 of the flange 102. The flange 102 is also provided with a rectangular aperture 122 which extends outwardly from the sleeve 92 between the two slots 116 to form two narrow strips 124 which connect the tabs 118 to the flange 102. The narrow strips 124 form a hinge connection between the tabs 118 and the flange 102 which provides resiliency to permit the tooth 120 to resiliently engage the third pair of magnet rings 24.

The flange 102 is also provided with a U-shaped slot 126 on each side of each tab 118. The slot 126 has a central portion 128 which confronts the edge of the flange 102 and end portions which extend inwardly to the sleeve 92. The U-shaped slots 126 form picks 132 which extend upwardly from the surface 106 of the flange 102, and the magnet rings 24 of the third pair are placed under frictional tension between the teeth 120 and the picks 132.

The magnet rings 20 and 22 are identical in shape and are provided with a plurality of magnetic north and south poles alternating at equal spacing about the rings. The magnetic rings 24 have an axial opening 134 which conforms to the outer surface of the sleeve 92 and the magnetic rings 24 are rotatable thereon. Further the outer diameter of the magnetic rings 24 is substantially less than that of the rings of the first and second pair. The third pair of rings 24 are the purity rings of the convergence assembly, and are magnetized with a single pair of magnetic poles disposed on opposite sides of the rings 24. Each ring of the three pairs of rings 20, 22 and 24 is provided with an outwardly extending tab 136 to facilitate rotation of that ring with respect to the other ring of that pair and with respect to the neck 10 of the picture tube.

The base unit 12, central unit 14, and cap unit 16 are all molded of plastic. The preferred construction utilizes NOREL SE1 plastic from General Electric Company, but other plastics such as LEXAN may be used, the preferred plastic being selected for its memory, heat and burn resistance and price. The base unit 14 and central unit 16 are identical except the base unit 14 utilizes pins 76 in place of the channels 66 of the central unit 16, and therefore the base unit 14 and central unit 16 may be molded from a single die shaped to form the central unit 16, the base unit 14 being formed by the installation of removable pegs in the pin forming recesses of the mold.

From the foregoing description of the invention, those skilled in the art will devise many modifications and applications of the present invention. It is therefore intended that the scope of the present invention be not limited by the specific example disclosed, but rather only by the appended claims.

The invention claimed is:

1. A device for mounting a pair of magnet rings on a substantially cylindrical neck comprising a cylindrical collar having a central axis adapted to be disposed coaxial with the neck and a diameter greater than the diameter of the cylindrical neck, a first plurality of elongated fingers mounted at one end thereof on the collar and extending toward the central axis, and a second plurality of elongated fingers mounted at one end thereof on the collar and extending toward the central axis, each of the fingers having an end opposite the collar with an elongated straight edge parallel to the central axis and disposed on a cylindrical surface of revolution with a diameter less than the diameter of the cylindrical neck, and the fingers of the first and second pluralities intersecting the cylindrical surface of revolution at supplementary acute angles, a pair of flat cylindrical rings of magnetic material provided with a central cylindrical opening of a diameter greater than the outer diameter of the cylindrical collar, and means for mounting the rings in abuttment with each other with the openings of the rings disposed co-axially about the collar.

2. A device for mounting a pair of magnet rings on a substantially cylindrical neck comprising the combination of claim 1 wherein each of the fingers has a uniform rectangular cross section extending between the ends thereof and a flat rectangular end opposite the collar.

3. A device for mounting a pair of magnet rings on a substantially cylindrical neck comprising the combination of claim 1 wherein the axis of elongation of each of the fingers at the end thereof opposite the collar is disposed at an angle to a radial plane of the collar traversing the opposite end of the finger less than 60 degrees.

4. A device for mounting a pair of magnet rings on a substantially cylindrical neck comprising the combination of claim 1 wherein the longitudinal axis of each of the fingers is a circular segment centered exteriorly of the collar.

5. A device for mounting a pair of magnet rings on a substantially cylindrical neck comprising the combination of claim 1 wherein the collar is provided with a plurality of hubs disposed on radial planes of the collar at common angles to each other, the hubs dividing the collar into segments of equal length, one finger of the first plurality and one finger of the second plurality extending outwardly from each hub, and the magnet rings being disposed in slidable abuttment with the hubs.

6. A device for mounting a pair of magnet rings on a substantially cylindrical neck comprising the combination of claim 1 wherein the collar is provided with a plurality of hubs disposed on radial planes of the collar at common angles to each other, the hubs dividing the collar into segments of equal length, one finger of the first plurality and one finger of the second plurality extending outwardly from each hub, and the magnet rings being disposed in slidable abuttment with the hubs, each of the fingers having a uniform rectangular cross section extending between the ends thereof and a flat rectangular end opposite the collar, the longitudinal axis of each of the fingers being a circular segment centered exteriorly of the collar, and the longitudinal axis of each of the fingers at the end thereof opposite the collar being disposed at an angle to a radial plane of the collar traversing the opposite end of the finger less than 60 degrees.

7. A device for mounting two pairs of magnet rings on a substantially cylindrical neck comprising the claim 1 combination of with a second cylindrical collar and means for mounting the second cylindrical collar on the first cylindrical collar, the second cylindrical collar having a central axis coaxial with the central axis of the first collar and a diameter greater than the diameter of the cylindrical neck, a first plurality of elongated fingers mounted at one end thereof on the second collar and extending toward the central axis, and a second plurality of elongated fingers mounted at one end thereof on the second collar and extending toward the central axis, each of the fingers having an end opposite the second collar with an elongated straight edge parallel to the central axis and disposed on the cylindrical surface of revolution, and the fingers of the first and second pluralities intersecting the cylindrical surface of revolution at supplementary acute angles, a second pair of flat cylindrical rings of magnetic material provided with a central cylindrical opening of a diameter greater than the outer diameter of the cylindrical collar, and a second means for mounting the second pair of rings in abuttment with each other with the openings of the rings disposed co-axially about the second collar.

8. A device for mounting two pairs of magnet rings on a substantially cylindrical neck comprising the combination of claim 7 wherein the first and second collars are provided with an equal plurality of hubs, the hubs of each collar being disposed on common radial planes of the collars at common angles to each other, the hubs dividing the first and second collars into segments of equal length, one finger of the first plurality and one finger of the second plurality extending outwardly from each hub of the first collar and of the second collar, the second pair of magnet rings being disposed in slidable abuttment with the hubs of the second collar, and the means for mounting the first collar on the second collar comprising pins extending outwardly respectively a plurality of hubs of the first collar, a plurality of hubs of the second collar being provided with channels extending therein and the pins of the first collar being disposed within the channels of the second collar.

9. A device for mounting two pairs of magnet rings on a substantially cylindrical neck comprising the combination of claim 8 wherein each of the fingers of the first and second collars has a uniform rectangular cross section extending between the ends thereof and a flat rectangular end opposite the collar.

10. A device for mounting two pairs of magnet rings on a substantially cylindrical neck comprising the combination of claim 9 wherein the axis of elongation of each of the fingers of the first and second collars at the end thereof opposite the collar is disposed at an angle to a radial plane of the collar traversing the opposite end of the finger less than 60 degrees.

11. A device for mounting two pairs of magnet rings on a substantially cylindrical neck comprising the combination of claim 10 wherein the longitudinal axis of each of the fingers of the first and second collars is a circular segment centered exteriorly of the collar.

12. A device for mounting a pair of magnet rings on a substantially cylindrical neck comprising a cylindrical sleeve having a central axis adapted to be disposed coaxial with the neck and a diameter greater than the diameter of the cylindrical neck and opposite ends normal to the central axis, said sleeve having a flat flange extending outwardly therefrom at one end thereof, a pair of flat cylindrical rings of magnetic material provided with central cylindrical openings of a diameter greater than the outer diameter of the cylindrical sleeve disposed about the sleeve, one of the rings abutting the flange and the other abutting the one ring, said sleeve having a plurality of spaced teeth extending outwardly from the end thereof opposite the flange, each of the teeth abutting the other ring, the pair of rings being wedged between the flange and the teeth, and means for mounting the sleeve co-axially about the neck.

13. A device for mounting a pair of magnet rings on a substantially cylindrical neck comprising the combination of claim 12 wherein the sleeve is provided with a slot parallel to the central axis thereof on each side of each tooth, each slot extending between ends of the sleeve, thereby providing radial compliance to the teeth.

14. A device for mounting a pair of magnet rings on a substantially cylindrical neck comprising the combination of claim 13 wherein the slots in the sleeve extend into the flange, and a plurality of apertures equal in number to the teeth are disposed in the flange, each aperture being disposed between two adjacent slots and confronting a tooth.

15. A device for mounting a pair of magnet rings on a substantially cylindrical neck comprising the combination of claim 13 wherein the flange is provided with a plurality of U-shaped slots, each U-shaped slot having a central portion spaced from the sleeve and side portions extending therefrom toward the sleeve, each U-shaped slot forming a pick anchored on the flange adjacent to the sleeve and extending toward the perimeter of the sleeve, and each pick having a bend adjacent to the sleeve toward the end of the sleeve opposite the flange, the picks abutting the one magnetic ring.

16. A device for mounting a pair of magnet rings on a substantially cylindrical neck comprising a cylindrical sleeve having a central axis adapted to be disposed coaxial with the neck and a diameter greater than the diameter of the cylindrical neck and opposite ends normal to the central axis, said sleeve having a flat flange extending outwardly therefrom at one end thereof, a pair of flat cylindrical rings of magnetic material provided with central cylindrical openings of a diameter greater than the outer diameter of the cylindrical sleeve disposed about the sleeve, one of the rings abutting the flange and the other abutting the one ring, said sleeve having a plurality of spaced teeth extending outwardly from the end thereof opposite the flange, each of the teeth abutting the other ring, the pair of rings being wedged between the flange and the teeth, the sleeve being provided with a slot parallel to the central axis thereof on each side of each tooth, each slot extending between ends of the sleeve and into the flange, the flange being provided with a plurality of apertures equal in number to the teeth, each aperture being disposed between two adjacent slots and confronting a tooth, the flange being provided with a plurality of U-shaped slots, each U-shaped slot having a central portion spaced from the sleeve and side portions extending therefrom toward the sleeve, each U-shaped slot forming a pick anchored on the flange adjacent to the sleeve and extending toward the perimeter of the sleeve, and each pick having a bend adjacent to the sleeve toward the end of the sleeve opposite the flange, the picks abutting the one magnetic ring, and means for mounting the sleeve co-axially about the neck.

17. A device for mounting three pairs of magnet rings on a substantially cylindrical neck comprising claim 7 in combination with a cylindrical sleeve mounted co-axially on the second collar and having a diameter greater than the diameter of the cylindrical neck and opposite ends normal to the central axis, said sleeve having a flat flange extending outwardly therefrom at one end thereof, a third pair of flat cylindrical rings of magnetic material provided with central cylindrical openings of a diameter greater than the outer diameter of the cylindrical sleeve disposed about the sleeve, one of the rings of the third pair abutting the flange and the other abutting the one ring, said sleeve having a plurality of spaced teeth extending outwardly from the end thereof opposite the flange, each of the teeth abutting the other ring of the third pair, the rings of the third pair being wedged between the flange and the teeth.

18. A device for mounting three pairs of magnet rings on a substantially cylindrical neck comprising the combination of claim 7 wherein the first and second collars are provided with an equal plurality of hubs, the hubs of each collar being disposed on common radial planes of the collars at common angles to each other, the hubs dividing the first and second collars into segments of equal length, each of the hubs of the second collar having a channel extending therethrough parallel to the central axis thereof, one finger of the first plurality and one finger of the second plurality extending outwardly from each hub of the first collar and of the second collar, the second pair of magnet rings being disposed in slidable abuttment with the hubs of the second collar, the first collar having a plurality of pins extending outwardly respectively a plurality of hubs and the pins of the first collar being disposed within channels of the second collar, a cylindrical sleeve having a central axis and opposite ends normal to the central axis, said sleeve having a flat flange extending outwardly therefrom at one end thereof and a plurality of pins extending outwardly therefrom, the pins of the flange being disposed within channels of the second collar and the sleeve abutting the end of the second collar opposite the first collar, a third pair of flat cylindrical rings of magnetic material provided with central cylindrical openings of a diameter greater than the outer diameter of the cylindrical sleeve disposed about the sleeve, one of the rings of the third pair abutting the flange and the other abutting the one ring, said sleeve having a plurality of spaced teeth extending outwardly from the end thereof opposite the flange, each of the teeth abutting the other ring of the third pair, the third pair of rings being wedged between the flange and the teeth.

* * * * *